US006249934B1

(12) United States Patent
Moser

(10) Patent No.: US 6,249,934 B1
(45) Date of Patent: Jun. 26, 2001

(54) HINGE CUP WITH CUT-AWAY

(75) Inventor: Andreas Moser, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 09/563,464

(22) Filed: May 2, 2000

(51) Int. Cl.[7] ..... E05D 5/00
(52) U.S. Cl. ..... 16/382; 16/272; 16/297
(58) Field of Search ..... 16/382, 272, 297

(56) References Cited

U.S. PATENT DOCUMENTS 4,590,641 * 5/1986 Lautenschlager et al. ..... 16/382
5,347,687 * 9/1994 Lautenschlager ..... 16/382
5,979,017 * 11/1999 Karl ..... 16/382
6,049,946 * 4/2000 Cress et al. ..... 16/240

FOREIGN PATENT DOCUMENTS

3638992 A1 * 5/1988 (DE) ..... 16/297

* cited by examiner

*Primary Examiner*—Lynne H. Browne
*Assistant Examiner*—Aaron M. Dunwoody
(74) *Attorney, Agent, or Firm*—Kilpatrick Stockton LLP

(57) ABSTRACT

A hinge cup for mounting a hinge on a door of a furniture article, such as a desk of cabinet, which allows for an increased angular range of opening of the door relative to the door mounting frame of the furniture article. The hinge cup has a side defining a cut-away which is adjacent to a pivotal attachment of a hinge arm, wherein the cut-away receives the hinge arm in a fully open position thereby allowing an increased angular range of opening.

16 Claims, 2 Drawing Sheets

HINGE CUP WITH CUT-AWAY

FIELD OF THE INVENTION

The present invention relates generally to furniture hinges, and more particularly, to a hinge cup for mounting a hinge on a door of a furniture article, such as a desk of cabinet, which allows for an increased angular range of opening of the door relative to the door mounting frame of the furniture article.

BACKGROUND OF THE INVENTION

In the cabinetry industry, a typical construction feature, for example, in cabinets which are provided with doors, is a face frame on which the door is supported and hinged. The face frame members are affixed, for example, to an opening in the cabinet, and a pair of concealed hinges are affixed to an edge of one of the face frame members and the door.

A customary mounting method of affixing the concealed hinge to the face frame member utilizes a hinge mounting plate which is positioned on an edge of the face frame member and fastened to the face frame member with one or more fasteners, such as fastening screws, inserted through one or more openings in the mounting plate and into, for example, one or more corresponding pre-drilled holes in the face frame member. Alternatively, the face frame may be omitted entirely, for example, in frameless cabinets, and the hinge plate may be affixed directly to an edge of a cabinet wall member in a substantially similar way.

After mounting one hinge arm to the face frame member or cabinet wall member as described above, the hinge arm is often pivotally connected to a hinge cup which is received in a recess in the rear face of the door member, in an appropriate position to allow functional hanging of the door relative to the face frame or cabinet wall member. Such "hinge cups" are known in the art, and are disclosed, for example, in U.S. Pat. No. 5,604,956 to Grass. Such hinge cups provide a structure for pivotally connecting the hinge arm to a door member, as well as providing a recess for receiving a hinge arm when the installed door is in the closed position. Angled hinge arms may provide a certain increase in the angle of opening possible for doors using this type of hinge.

It is sometimes desirable that the angular range of opening of door be increased even further than that provided by angled hinge arms pivotally attached to conventional hinge cups. Applications which call for increased angular opening may include the installation of doors for corner cabinets, e.g. where such doors are hung as two parts hinged together.

Accordingly, it is one object of the present invention to provide a hinge cup having a structure allowing hinged doors to function with an increased angular range of opening.

SUMMARY OF THE INVENTION

It is a feature and advantage of the present invention to provide a hinge cup which is inexpensive to make, easy to use, and which enables, for example, concealed, edge-mounted type hinges to provide an increased angular range of opening for doors, such as cabinet doors.

To achieve the stated and other features, advantages and objects of the present invention, an embodiment of the present invention relates to a hinge providing increased angular opening, wherein the hinge comprises a hinge cup and a hinge arm, and the hinge cup further comprises an attachment point located proximal to a side of the hinge cup and adapted to pivotally secure the hinge arm to the hinge cup; and wherein the side of the hinge cup defines a cut-way positioned to receive the hinge arm when the hinge arm is in an open position.

Additional objects, advantages and novel features of the present invention will be set forth in part in the description which follows, and in part will become more apparent to those skilled in the art upon examination of the following or may be learned by practice of the invention.

DETAILED DESCRIPTION

The present invention provides a hinge cup which is inexpensive to make, easy to use, and which enables, for example, concealed, edge-mounted type hinges to provide an increased angular range of opening for doors, such as cabinet doors.

Accordingly, in one aspect, the invention relates to a hinge providing increased angular opening, wherein the hinge comprises a hinge cup and a hinge arm, and the hinge cup further comprises an attachment point located proximal to a side of the hinge cup and adapted to pivotally secure the hinge arm to the hinge cup; and wherein the side of the hinge cup defines a cut-way positioned to receive the hinge arm when the hinge arm is in an open position. More preferably, the cut-away is substantially rectangular. Also more preferably, the cut-away extends toward the attachment point adapted to pivotally secure a hinge arm to the hinge cup, a distance which is about one half of the depth of the hinge cup. Also more preferably, the cut-away extends toward the attachment point adapted to pivotally secure a hinge arm to said hinge cup, a distance which is about one third of the depth of said hinge cup. Also more preferably, the cut-away has a width which is substantially the same as a hinge arm adapted for use with the hinge cup. Also more preferably, the cut-way comprises a lower edge having spaced apart portions of increased depth adapted to receive one or more members of a hinge arm adapted for attachment to a pivot axis. Most preferably, the cut-away comprises a lower edge having a central raised portion which is adapted to function as a stop against further angular pivotal motion of a hinge arm in a fully opened position.

In a preferred embodiment, the hinge cup comprises edges which circumscribe a substantially circular parameter of the hinge cup.

In another preferred embodiment, the attachment point comprises at least one depression in an interior side of the hinge cup, wherein the at least one depression is adapted to receive and secure therein at least one pivot axis member adapted to secure a hinge arm.

In another preferred embodiment, the attachment point comprises at least one aperture in an interior side of the hinge cup, wherein the at least one aperture is adapted to receive and secure therein at least one pivot axis member adapted to secure a hinge arm.

Figure 1:
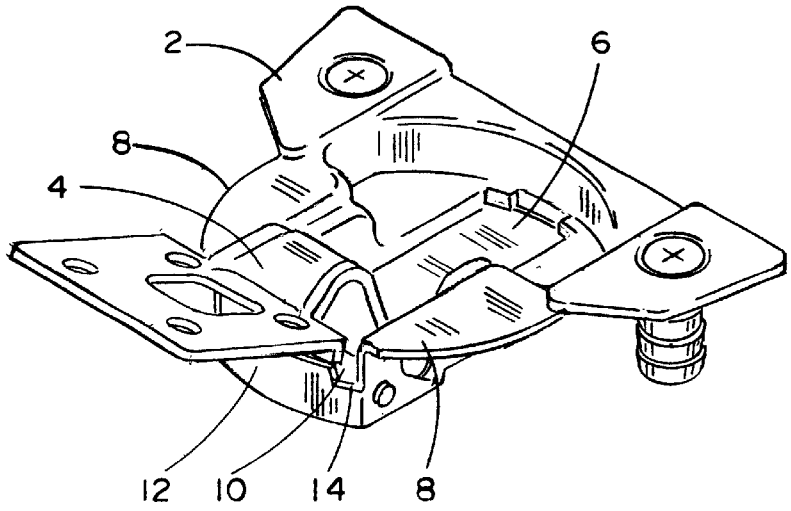
FIG. 1 is a top perspective view of one embodiment of a hinge cup of the present invention, with the pivotally mounted hinge arm in a partially open position.

Referring now in detail to an embodiment of the present invention, an example, of which is illustrated in the accompanying drawings, FIG. 1 shows a top perspective view of the hinge cup 2 for an embodiment of the present invention. Hinge cup 2 is shown attached to hinge arm 4 in a partially open position. It can be seen in FIG. 1 that hinge arm 4 is opened to a position approximating a fully open position for a hinge cup lacking the cut-away 10 formed in the hinge cup sides 8. When hinge cups lacking the cut-away of the present invention are used, the hinge cup side adjacent to the pivotal attachment of a hinge arm stops the hinge arm from further angular opening at a position defining a smaller angular range of opening because the hinge arm comes to rest on the side of the hinge cup which is substantially co-extensive with top perimeter of the hinge cup. In the interior of the hinge cup 2, recess 6 may be formed to receive a portion of an angled hinge arm when the hinge arm is in a fully closed position.

Figure 2:
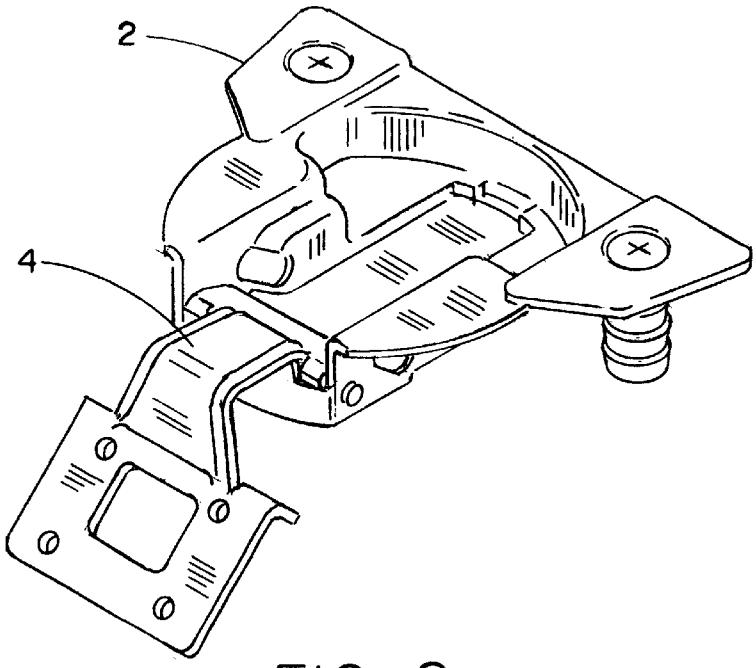
FIG. 2 is a top perspective view of the hinge of FIG. 1, showing the pivotally mounted hinge arm in a fully open position.

FIG. 2 shows a top perspective view of hinge cup 2 and hinge arm 4, wherein hinge arm 4 is in a fully open position. The increased angular range of opening is shown to be made possible by the cut-away 10 which receives hinge arm 4 in the fully open position.

Figure 3:
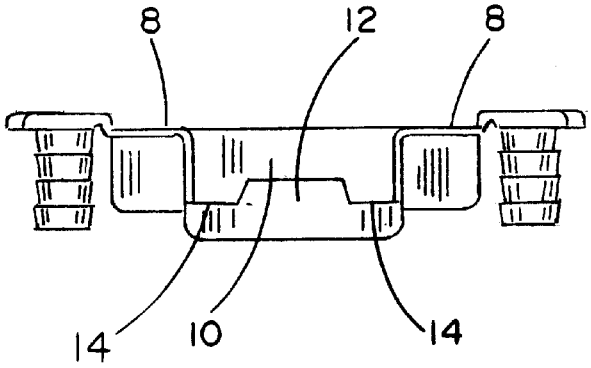
FIG. 3 is a side view of a hinge cup showing the cut-away which allows greater angular opening of the pivotally mounted hinge arm (hinge arm not shown).

FIG. 3 shows a side view of hinge cup 2 without attached hinge arm 4. FIG. 3 shows cut-away 10 formed in sides 8 of hinge cup 2. Cut-away 10 is shown, in one embodiment of the invention, as having raised portion 12, which is flanked by recessed areas 14. Raised portion 12 serves as a stop, and may contact the central portion of hinge arm 4 when hinge arm 4 is in a fully open position relative to hinge cup 2. Recessed areas 14 may serve to receive a portion of hinge arm 4 which is adapted to connect the hinge arm 4 to a pivot axis.

Figure 4:
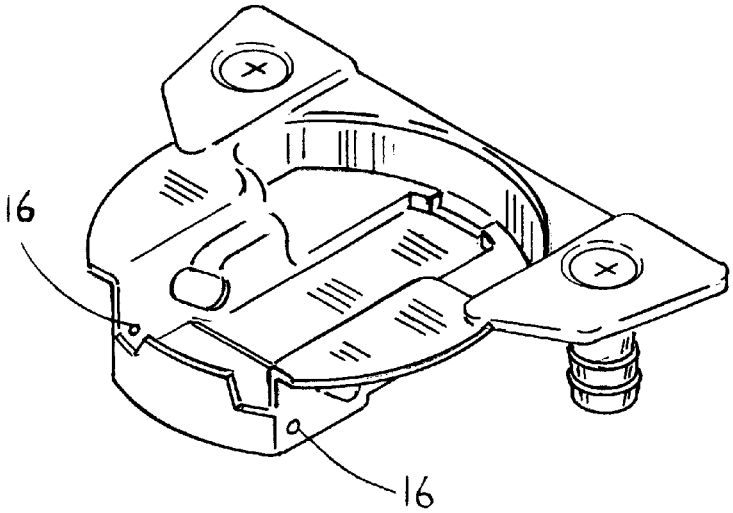
FIG. 4 is an interior perspective view of the hinge cup, showing one embodiment of the invention having apertures for receiving a pivot axis for attachment of a hinge arm (hinge arm and pivot axis not shown).

FIG. 4 shows an top perspective view of hinge cup 2 without attached hinge arm 4. FIG. 4 shows one embodiment of the invention having apertures 16 for receiving and securing therein a pivot axis adapted to connect hinge arm 4 to hinge cup 2.

The hinge cup of the invention may be utilized with a variety of hinge arms known in the art. Similarly, the hinge cups of the invention may be produced having a variety of attachment structures for pivotally securing a hinge arm. The cut-away portion in the side of the hinge cup adjacent to the pivotal attachment of the hinge arm allows increased angular opening compared to hinge cups having sides lacking such a cut-away to received a hinge arm in a fully open position.

Various preferred embodiments of the present invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention. Accordingly, the invention is limited only by the following claims.

What is claimed is:

1. A hinge providing increased angular opening, said hinge comprising a hinge cup and a hinge arm, wherein said hinge cup further comprises an attachment point located proximal to a side of said hinge cup and adapted to pivotally secure said hinge arm to said hinge cup; wherein said side of said hinge cup defines a cut-away positioned to receive said hinge arm when said hinge arm is in an open position; and wherein said cut-way comprises a lower edge having spaced apart portions of increased depth adapted to receive one or more members of a hinge arm adapted for attachment to a pivot axis.

2. The hinge of claim 1, wherein said hinge cup comprises edges which circumscribe a substantially circular parameter of said hinge cup.

3. The hinge of claim 1, wherein said attachment point comprises at least one depression in an interior side of said hinge cup, wherein said at least one depression is adapted to receive and secure therein at least one pivot axis member adapted to secure a hinge arm.

4. The hinge of claim 1, wherein said attachment point comprises at least one aperture in an interior side of said hinge cup, wherein said at least one aperture is adapted to receive and secure therein at least one pivot axis member adapted to secure a hinge arm.

5. The hinge of claim 1, wherein said cut-away is substantially rectangular.

6. The hinge of claim 1, wherein said cut-away extends toward the attachment point adapted to pivotally secure a hinge arm to said hinge cup, a distance which is about one half of the depth of said hinge cup.

7. The hinge of claim 1, wherein said cut-away extends toward the attachment point adapted to pivotally secure a hinge arm to said hinge cup, a distance which is about one third of the depth of said hinge cup.

8. The hinge of claim 1, wherein said cut-away has a width which is substantially the same as a hinge arm adapted for use with said hinge cup.

9. A hinge providing increased angular opening, said hinge comprising a hinge cup and a hinge arm, wherein said hinge cup further comprises an attachment point located proximal to a side of said hinge cup and adapted to pivotally secure said hinge arm to said hinge cup; wherein said side of said hinge cup defines a cut-away positioned to receive said hinge arm when said hinge arm is in an open position; and wherein said cut-away comprises a lower edge having a central raised portion which is adapted to function as a stop against further angular pivotal motion of a hinge arm in a fully opened position.

10. The hinge of claim 9, wherein said hinge cup comprises edges which circumscribe a substantially circular parameter of said hinge cup.

11. The hinge of claim 9, wherein said attachment point comprises at least one depression in an interior side of said hinge cup, wherein said at least one depression is adapted to receive and secure therein at least one pivot axis member adapted to secure a hinge arm.

12. The hinge of claim 9, wherein said attachment point comprises at least one aperture in an interior side of said hinge cup, wherein said at least one aperture is adapted to receive and secure therein at least one pivot axis member adapted to secure a hinge arm.

13. The hinge of claim 9, wherein said cut-away is substantially rectangular.

14. The hinge of claim 9, wherein said cut-away extends toward the attachment point adapted to pivotally secure a hinge arm to said hinge cup, a distance which is about one half of the depth of said hinge cup.

15. The hinge of claim 9, wherein said cut-away extends toward the attachment point adapted to pivotally secure a hinge arm to said hinge cup, a distance which is about one third of the depth of said hinge cup.

16. The hinge of claim 9, wherein said cut-away has a width which is substantially the same as a hinge arm adapted for use with said hinge cup.

* * * * *